United States Patent [19]

A'Costa

[11] Patent Number: 4,660,312

[45] **Date of Patent: * Apr. 28, 1987**

[54] RIFLED GUN BARREL HAVING SMOOTH BORE SECTION

[76] Inventor: Anthony A'Costa, Box 5806, 710 W. 4th St., Suite E, Pueblo, Colo. 81002

[ * ] Notice: The portion of the term of this patent subsequent to Feb. 11, 2003 has been disclaimed.

[21] Appl. No.: 784,032

[22] Filed: Oct. 4, 1985

Related U.S. Application Data

[63] Continuation-in-part of Ser. No. 516,230, Aug. 15, 1983, which is a continuation-in-part of Ser. No. 131,318, Apr. 27, 1982, and a continuation-in-part of Ser. No. 613,180, May 23, 1984.

[51] Int. Cl.[4] ..... F41C 21/00; F41C 21/08

[52] U.S. Cl. ..... 42/76.01; 42/77; 42/78

[58] Field of Search ..... 42/76 R, 77, 78

[56] References Cited

U.S. PATENT DOCUMENTS

| | | | |
|---|---|---|---|
| 37,193 | 12/1862 | Alsop | 42/78 |
| 3,525,172 | 8/1970 | Marshall et al. | 42/78 |
| 4,546,564 | 10/1985 | A'Costa | 42/78 |
| 4,570,529 | 2/1986 | A'Costa | 89/14.2 |

OTHER PUBLICATIONS

L. R. Wallack, *American Rifle Design and Performance,* Winchester Press, New York, 1977.

*Primary Examiner*—Donald P. Walsh
*Assistant Examiner*—Ted L. Parr
*Attorney, Agent, or Firm*—Harold H. Dutton, Jr.

[57] ABSTRACT

A gun barrel having a rifled-bore section at the breech end thereof and a smooth-bore section at the muzzle end thereof, the sections having a gas tight connection therebetween, the rifled-bore section comprising a first generally tubular body having a longitudinal bore and at least one spiral groove formed in the wall of the bore to a depth of a predetermined dimension, the rifled-bore section having a length corresponding substantially to the peak pressure point for the gun barrel, the smooth-bore section comprising a second generally tubular body having a longitudinal bore coaxial with the longitudinal bore of the rifled-bore section, and the longitudinal bore of the smooth-bore section having a diameter greater than the diameter of the bore of the rifled-bore section and less than the diameter of the spiral rifling groove.

4 Claims, 2 Drawing Figures

RIFLED GUN BARREL HAVING SMOOTH BORE SECTION

CROSS REFERENCE TO RELATED APPLICATIONS

This application is a continuation in part of copending application Ser. No. 516,230 filed Aug. 15, 1983 which in turn is a continuation in part of application Ser. No. 131,318 filed Apr. 27, 1982. This application is also a continuation-in-part of application Ser. No. 613,180 filed May 23, 1984.

This invention relates to an Improved Gun Barrel Construction. More particularly, the invention relates to a gun barrel which combines the technologies of rifled bores and smooth-bores into the improved gun barrel.

BACKGROUND OF THE INVENTION

In the early development of rifles, and the like, the barrels of such weapons were usually of such a character that the internal bore of the barrel was essentially smooth. Such weapons were in use for many years with black powder, a forerunner of modern day smokeless powders. One early attempt at improving the accuracy of such barrels was disclosed U.S. Pat. No. 37,193 issued to C. R. Alsop on Dec. 16, 1862. This patent sought to improve the accuracy of smooth-bore gun barrels by attaching a rifled section to the muzzle end of a conventional smooth-bore gun barrel. The rifled section that was added was generally two to three inches in length, and the direction of twist of the rifling was opposite to that of the threads which connected the rifled section to the smooth-bore barrel. By such a technique, the projectile when it entered the rifled section of the barrel would have a tendency to tighten the threaded connection of the extension on the barrel.

The Alsop patent recognized that the rifling imparted a significant degree of friction to the projectile, but it found that placing the beginning point of the rifling far enough down the barrel away from the breech end, the friction was said to be overcome by the accumulated momentum of the projectile.

This patent also suggested a gradual reduction in diameter of the bore of the barrel progressing away from the breech end into the rifled portion.

However, the early teachings of this Alsop patent could not be carried forward into modern day technology because of the great differences in projectiles and in the powders used in the ammunition for such gun barrels. Were this technology to be used with modern day ammunition, an explosion of the barrel would be the likely result.

As a consequence, smooth-bore rifles essentially disappeared, and the smooth-bore technology currently is primarily only used in antique type or replica weapons using black powder, or shot guns which use a smooth-bore with a constriction or choke at the end of the barrel to contain a pattern of shot in the cartridge, as opposed to a single projectile.

Shotguns are also occasionally used with a single projectile or "slug", but the accuracy of such ammunition is relatively poor. This accuracy is improved, however, by using a so-called "rifled slug" which has rifling grooves on the outer surface of the slug to impart a spin to the projectile. While being an improvement, this does not achieve the accuracy of a rifled barrel.

It has long been known that the presence of rifling grooves in a gun barrel imparts substantial friction to the projectile. While this in itself would be detrimental to long range accuracy, the development of modern day gun powders has in effect overcome the disadvantages of the friction of rifling to the extent that the rifling is currently used in most all gun barrels, for the rotary motion or spin it imparts to the projectile to stabilize the projectile in flight which in turn improves the accuracy of the weapon.

More recently, U.S. Pat. No. 3,525,172 to R. L. Marshall et al, issued on Aug. 25, 1970, combined the technologies of smooth-bore barrel design and rifled barrel design to obtain an improved accuracy using modern day ammunition and powders. This patent discloses an improved gun barrel wherein the rifling in the barrel extends from the breech end of the barrel to the point along the length of the barrel at which the gas pressure in the barrel reaches a maximum, and from that point forward towards the muzzle end of the barrel, the barrel has a smooth, unrifled bore. In this manner, improved velocity and accuracy of the projectile could be obtained.

The improvements in applications Ser. No.'s 131,318 and 516,230 related to the improvements over the earlier Marshall et al patent whereby the end portion of the barrel, i.e. the smooth-bore section of the barrel was connected to the rifle portion of the barrel by a threaded, releasable connection between the two barrel sections.

The particular threaded connection between the two barrel sections enabled easier replacement of either barrel section after wear, and additionally provided sealing surfaces between the two sections of the barrel to minimize or eliminate the loss of gas pressure at the transition between the two barrel sections.

One of the disadvantages of the Marshall et al patent was the difficulty in producing a barrel having the rifling along one portion and a smooth-bore along the other portion of the bore. It is very difficult to accurately control the internal dimensions of such a barrel which was produced from a single piece of stock. Further, the concentricity of the bore with respect to the barrel was jeopardized, and fluctuations in the concentricity were significant, such that heat build-up would cause thermal distortion of the barrel resulting in reduced accuracy.

Moreover, it has been found that simply the provision of a smooth-bore section at the end of the rifled portion of the barrel does not necessarily result in the improved benefits of the weapon. The bore itself must be accurately machined with respect to the characteristics of the rifling section of the barrel, and the caliber of the gun.

Accordingly, a primary object of this invention is to provide an improved gun barrel combining smooth-bore and rifled-bore technology.

Still another object of this invention is to provide an improved gun barrel in which the smooth-bore section at the muzzle end of the gun is configured in a predetermined manner in relation to the rifled section of the barrel.

Still another object of this invention is to provide a two piece gun barrel wherein a smooth-bore section at the muzzle end is threadedly connected to a rifled barrel section at the breech end.

Still a further object of this invention is to provide an improved barrel construction wherein the diameter of the bore in the smooth-bore section is intermediate the diameters of the lands and the grooves in the rifled section.

These and other objects in advantages of this invention will become apparent when considered in light of the following description and claims when taken together with the accompanying drawings.

DESCRIPTIONS OF THE DRAWINGS

The invention will now be described further with reference to the accompanying drawings in which.

BRIEF DESCRIPTION OF INVENTION

Figure 1:
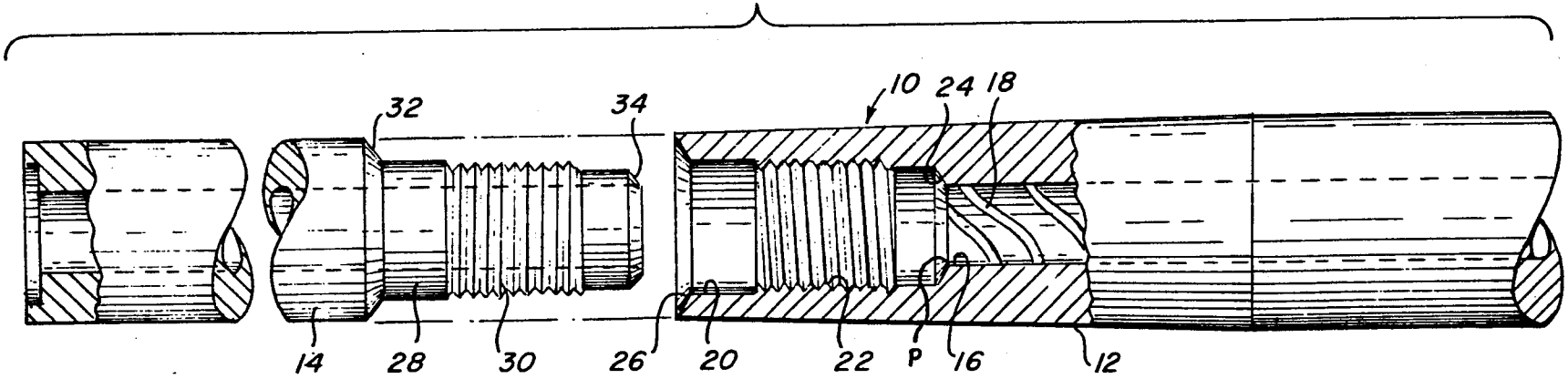
FIG. 1 is a fragmentary plan view of a barrel design according to the present invention with portions broken away for clarity.

The improved gun barrel according to the present invention may be brought about by the modification of an existing gun barrel, or in an entirely new gun barrel. In the case of a modification, an existing gun barrel is cut off at a length from the breach end at which the peak gas pressure within the barrel is located. This point may be determined experimentally by appropriate measurements for different calibers of guns and different types of ammunition as discussed in U.S. Pat. No. 3,525,172. The rifled portion of the gun barrel extends to this point, is then terminated at this point, and at this point of peak pressure, the transition occurs to a smooth-bore barrel section.

In the rifled bore, the internal section of the barrel is provided with rifling, which essentially comprises one or more spiral grooves in the nature of a helix on the interior of the barrel along its length. The smooth-bore section is of a constant diameter. The diameter of the smooth-bore portion, must be between the diameter of the lands and the diameter of the grooves in the rifled portion of the barrel.

Of course the actual diameter of the smooth-bore portion is a function of the caliber of the gun, but this diameter is slightly greater than the diameter of the land areas of the rifled section and slightly less than the diameter of the bottom of the grooves. Thus, the diameter of the land areas of the barrel would be defined as the diameter of a circle the center of which lies on the longitudinal axis of the bore and which circle is the internal dimension of the bore. Likewise the diameter of the groove areas is the diameter of a circle whose center lies on the longitudinal axis of the bore and which passes through the bottom or radially outermost portion of the grooves.

In a conventional rifled barrel, the barrel has a bore of a given dimension and rifling grooves thus have a slightly greater diameter than the bore diameter. For example, the bore diameter of a .223 caliber rifle barrel is 0.2190 inch, while the depth of the rifling grooves is such that the diameter of a circle passing through the bottom of the grooves would be 0.2240 inch. In another words, the grooves have a depth of 0.0025 inch, i.e. one-half the difference between the bore diameter and the groove diameter. For such a rifle, the bullet has an initial diameter of 0.224 inch, and as the bullet passes through the barrel it is reduced slightly in diameter in the area of the bore and is elongated slightly as it passes through the barrel.

Preferably, the smooth-bore section of the rifle barrel has a diameter of 0.0006 to 0.0008 inch less than the diameter of a circle passing through the bottom of the rifling grooves, as this has been found to provide the optimum effect and enhancement of the ballistic characteristics of the projectile, and to allow for improved thermal expansion of the bullet..

The length of the smooth-bore section of the rifle barrel is not particularly critical, and is more a function of the additional length desired for a given rifle. Typically the smooth-bore portion would be about 8–20 inches in length.

By this construction, as the bullet travels down the rifled section of the barrel, its velocity progressively increases with increasing gas pressure. As it travels, the rifling in the breech end portion of the barrel imparts a rotary motion or spin to the bullet. As the bullet enters the smooth-bore section, the gas pressure behind the projectile has reached a maximum but the friction greatly diminishes and the projectile continues to rotate and is further stabilized both as to rotary motion and longitudinal motion in the smooth-bore, reduced friction portion of the barrel. The result is increased muzzle velocity and improved trajectory and ballistic characteristics of the projectile.

The two barrel sections may be joined together by a threaded connection. Preferably, the rifled section of the barrel is provided with a threaded female portion, and the smooth-bore extension section of the barrel is provided with a corresponding male threaded section. At the ends of the threaded sections are chamfered mating surfaces, which further assist in providing a gas-tight connection between the two barrel sections.

DESCRIPTION OF THE PREFERRED EMBODIMENTS

Referring now to the accompanying drawings, the gun barrel 10 according to the present invention is seen to include a first barrel section 12 and a second, smooth-bore extension section 14. The barrel section 12 is provided with an internal bore 16 and the internal bore has rifling grooves 18 formed therein in a conventional manner. The breech end of the barrel section is toward the right as seen in the drawings, and the end of the barrel section 12 away from the breech end is provided with a bore 20 of greater diameter than the bore 16, for receiving the barrel section 14. The rifling 18, and the first section of the bore 16 terminate at a point P at which point the pressure in the barrel reaches a maximum.

The section 20 of increased internal diameter is internally threaded as at 22, and is also provided with a chamfered surface 24 adjacent to the rifled bore 16. The distal end of the barrel section 12 is also provided with a chamfered section 26. The two chamfered sections 24 and 26 provide sealing surfaces as will be explained further.

The section 14 of the barrel is provided with a portion 28 which is machined to a dimension slightly less than the inside diameter of the portion 20 of the barrel section 12. The extension 28 is externally threaded as at 30 with threads such as to cooperate with threads 22 on the barrel section 12 and provide a tight mechanical connection between the sections 12 and 14.

The barrel section 14 is provided with chamfered surfaces 32 and 34 which are configured so as to mate with chamfered sections 26 and 24 respectively of the barrel section 12. These surfaces, then, form a seal which cooperates with the thread connection between sections 22 and 30 to provide a gas-tight connection between the two barrel sections 12 and 14.

Figure 2:
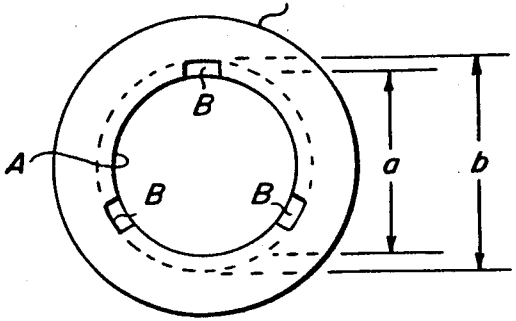
FIG. 2 is an enlarged cross sectional schematic of the rifled portion of a gun barrel.

The diameter of the bore 16 of the barrel section 12 is shown on an enlarged scale in FIG. 2, wherein A designates the internal bore 16, and is provided on its inside surface with a plurality of spirally arranged rifling grooves B corresponding to grooves 18. The diameter of the bore A is thus given by "a". The bottoms of the rifling grooves B lie on a circle whose diameter is given by "b". Accordingly, the inside diameter "SB" of the smooth-bore section 14 is given by the expression:

$$b > SB > a.$$

In a preferred embodiment, particularly for use with rifles of a caliber of .223 up to 0.45, the diameter of the smooth-bore section 14 would be given by the expressions $SB = b - \{0.0006 - 0.0008 \text{ inch}\}$ and $SB > a$.

When these relationships are met the projectile will be squeezed down slightly in diameter and elongated as it passes into the smooth-bore section 14, and the continued burn of the powder and gases will result in increased acceleration as the bullet passes through the smooth-bore section 14 of the rifle.

It will be apparent that an existing rifle barrel may be cut off at the determined peak pressure point, and provided with the internal threads as described above, so that an appropriate smooth-bore section may be attached thereto. For a permanent modification of a gun barrel, or for cases in which no change will be made in the length of the barrel, the smooth-bore portion may be permanently affixed to the rifled section as, for example by a sweating technique.

While this invention is described as having certain preferred features and embodiments, it will be understood that it is capable of still further variation and modification without departing from the spirit of the invention. Accordingly, this application is intended to cover any and all variations, modifications and adapatations which come within the spirit of the invention and the scope of the appended claims.

What I claim is:

1. A gun barrel having a rifled-bore section at the breech end thereof and a smooth-bore section at the muzzle end thereof, said sections having a gas tight connection therebetween, said rifled-bore section comprising a first generally tubular body having a longitudinal bore and at least one spiral groove formed in the wall of said bore to a depth of a predetermined dimension, said rifled-bore section having a length corresponding substantially to the peak pressure point for the gun barrel, said smooth-bore section comprising a second generally tubular body having a longitudinal bore coaxial with the longitudinal bore of said rifled-bore section, and the longitudinal bore of said smooth-bore section having a diameter greater than the diameter of the bore of said rifled section and less tnan tne diameter or said at least one spiral groove.

2. A gun barrel as in claim 1 and wherein said gas tight connection comprises a threaded connection.

3. A gun barrel as in claim 2 and wherein said gas tight connection comprises coacting chamfers on said rifled-bore section and said smooth-bore section.

4. A gun barrel as in claim 1 and wherein the internal diameter of the smooth-bore portion is about 0.00060–0.0008 inch less than the diameter of said at least one groove.

* * * * *